US008857953B2

(12) United States Patent
Suzuki et al.

(10) Patent No.: US 8,857,953 B2
(45) Date of Patent: Oct. 14, 2014

(54) LIQUID EJECTION HEAD FORMED OF PIEZOELECTRIC PLATES

(71) Applicant: Canon Kabushiki Kaisha, Tokyo (JP)

(72) Inventors: Toshio Suzuki, Sagamihara (JP); Shinan Wang, Kashiwa (JP); Toru Nakakubo, Kawasaki (JP); Manabu Sueoka, Yokohama (JP); Tsunenori Soma, Kawasaki (JP); Ryota Kashu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/714,679

(22) Filed: Dec. 14, 2012

(65) Prior Publication Data

US 2013/0162725 A1 Jun. 27, 2013

(30) Foreign Application Priority Data

Dec. 22, 2011 (JP) ..... 2011-281731

(51) Int. Cl.
*B41J 2/045* (2006.01)
*B41J 2/14* (2006.01)

(52) U.S. Cl.
CPC .... *B41J 2/14201* (2013.01); *B41J 2002/14491* (2013.01); *B41J 2202/12* (2013.01); *B41J 2/14209* (2013.01); *B41J 2202/19* (2013.01)
USPC ..... 347/71; 347/72; 347/68; 347/65

(58) Field of Classification Search
CPC ..... B41J 2/14201; B41J 2/14209
USPC ..... 347/65, 68–72
See application file for complete search history.

(56) References Cited

U.S. PATENT DOCUMENTS

| | | | | |
|---|---|---|---|---|
| 6,137,506 | A | 10/2000 | Sueoka | |
| 7,128,406 | B2 | 10/2006 | Dixon et al. | |
| 7,770,990 | B2 | 8/2010 | Nagashima | |
| 8,191,994 | B2 | 6/2012 | Nakakubo et al. | |
| 8,376,525 | B2 | 2/2013 | Asai et al. | |
| 8,449,077 | B2 * | 5/2013 | Nishikawa | 347/54 |
| 2009/0284569 | A1 * | 11/2009 | Kawaguchi et al. | 347/68 |
| 2012/0033015 | A1 | 2/2012 | Kashu et al. | |
| 2012/0113197 | A1 | 5/2012 | Kashu et al. | |
| 2013/0002769 | A1 * | 1/2013 | Koseki | 347/71 |
| 2013/0220522 | A1 | 8/2013 | Wang | |

FOREIGN PATENT DOCUMENTS

| | | | |
|---|---|---|---|
| JP | 2007-118611 | A | 5/2007 |
| JP | 2007-168319 | A | 7/2007 |
| JP | 2008-87288 | A | 4/2008 |

* cited by examiner

*Primary Examiner* — Henok Legesse
(74) *Attorney, Agent, or Firm* — Fitzpatrick, Cella, Harper & Scinto

(57) ABSTRACT

A liquid ejection head includes a piezoelectric block body having a plurality of pressure chambers arranged two-dimensionally to face respective ejection ports, a plurality of air chambers arranged adjacently relative to the plurality of pressure chambers, and a plurality of flow channels arranged along the pressure chambers. The pressure chambers are deformed by expansion and contraction of piezoelectric members disposed between the pressure chambers and the air chambers so as to drive the liquid stored therein to flow toward the ejection ports. A connection flow channel is provided at the ejection port side of the piezoelectric block body so as to make each of the pressure chambers communicate with at least one of the flow channels for partial recirculation of the ink.

14 Claims, 17 Drawing Sheets

LIQUID EJECTION HEAD FORMED OF PIEZOELECTRIC PLATES

BACKGROUND OF THE INVENTION

1. Field of the Invention

The present invention relates to a liquid ejection head for ejecting liquid such as ink.

2. Description of the Related Art

Inkjet recording apparatus for recording images on a recording medium by ejecting ink are generally equipped with a liquid ejection head for ejecting ink. Known mechanisms by which liquid ejection heads eject ink include those employing a contractible pressure chamber and a piezoelectric element for causing the pressure chamber to contract and reduce the volume thereof. With such a mechanism, the piezoelectric element is deformed as a voltage is applied thereto to thereby cause the pressure chamber to contract so that the ink in the pressure chamber is forcibly ejected from an ejection port formed at an end of the pressure chamber. Shear-mode type liquid ejection heads are known as a type of liquid ejection head having such a mechanism. In a shear-mode type liquid ejection head, one or two of the inner wall surfaces of the pressure chamber are formed by a piezoelectric element and the pressure chamber is forced to contract by applying a voltage to the piezoelectric element so as to cause the latter to generate a shear deformation.

Inkjet apparatus for industrial applications are required to use high viscosity liquid. Then, the liquid ejection head of such an inkjet apparatus is required to provide high power for liquid ejection. To meet the requirement, Gould type liquid ejection heads having a pressure chamber formed by a cylindrical piezoelectric member that represents a circular or rectangular cross section have been proposed. In Gould type liquid ejection heads, the piezoelectric member is deformed uniformly in radial directions relative to the center of the pressure chamber to cause the pressure chamber to expand or contract. In Gould type liquid ejection heads, all the wall surfaces of the pressure chamber are deformed and the deformation contributes to the power for ink ejection and hence the Gould type liquid ejection head can provide high power for liquid ejection if compared with the shear-mode type liquid ejection head in which only one or two inner wall surfaces of the pressure chamber are formed by a piezoelectric element.

For a Gould type liquid ejection head to achieve a higher image resolution, a plurality of ejection ports need to be highly densely arranged. Then, as a result, pressure chambers that correspond to respective ejection ports also need to be highly densely arranged. Japanese Patent Application Laid-Open No. 2007-168319 discloses a method of manufacturing a Gould type liquid ejection head in which pressure chambers can be highly densely arranged.

According to the manufacturing method disclosed in Japanese Patent Application Laid-Open No. 2007-168319, a plurality of grooves extending in the same direction are formed on each of a plurality of piezoelectric plates. Subsequently, the piezoelectric plates are laid on one another such that the grooves are aligned, and then cut in a direction orthogonal to the extending direction of the grooves. The groove portions of the piezoelectric plates that are cut apart form the inner wall surfaces of the pressure chambers of the liquid ejection head. Thereafter, the piezoelectric members interposed between adjacent pressure chambers for separating the pressure chambers are removed to a predetermined depth. As the pressure chambers are completely formed, a supply channel plate and an ink pool plate, and a printed circuit board and a nozzle plate are connected to the tops and the bottoms of the piezoelectric plates to produce a complete liquid ejection head. Thus, with the manufacturing method disclosed in Japanese Patent Application Laid-Open No. 2007-168319, pressure chambers can be arranged in a matrix and highly densely. Additionally, with this manufacturing method, pressure chambers can be formed highly precisely because an operation of forming grooves on piezoelectric plates can be executed more easily than an operation of forming holes in piezoelectric plates.

A plurality of pressure chambers are separated by spaces in a liquid ejection head manufactured by the manufacturing method disclosed in Japanese Patent Application Laid-Open No. 2007-168319. Therefore, if the liquid ejection head is made to include pressure chambers having a large length (height) for the purpose of ejecting high viscosity liquid (by boosting the power for ejecting liquid), the rigidity of the liquid ejection head is inevitably reduced. As the rigidity of such a liquid ejection head is reduced, the structure surrounding the pressure chambers is apt to be broken to make the liquid ejection head no longer possible to eject liquid in some instances.

Meanwhile, Japanese Patent Application Laid-Open No. 2007-118611 and Japanese Patent Application Laid-Open No. 2008-087288 disclose methods of driving liquid droplets located in and near the nozzles of a liquid ejection head to circulate during a printing operation in order to prevent dust, dried ink and foreign objects from accumulating in the nozzles and suppressing the lingering of air bubbles in the nozzles. However, these patent documents do not represent any circulation channel structure that is effective for Gould type liquid ejection heads including a plurality of two-dimensionally arranged pressure chambers.

SUMMARY OF THE INVENTION

According to the present invention, there is provided a liquid ejection head including: a piezoelectric block body that has a plurality of pressure chambers arranged two-dimensionally to face respective ejection ports for ejecting liquid so as to be capable of storing liquid, a plurality of air chambers arranged adjacently relative to the plurality of pressure chambers and a plurality of flow channels arranged along the pressure chambers so as to be capable of supplying liquid, the pressure chambers, the air chambers and the flow channels being formed therein with piezoelectric members disposed between the plurality of pressure chambers and the plurality of air chambers so as to drive the liquid stored in the pressure chambers to flow toward the ejection ports by causing the inner walls of the pressure chambers to be deformed by expansion and contraction; and a connection flow channel that makes each of the pressure chambers communicate with at least one of the flow channels at the side of the related ejection port.

According to the present invention, there is also provided a liquid ejection head including: a pressure chamber communicating with an ejection port for ejecting liquid and capable of storing liquid; an air chamber formed adjacently relative to the pressure chamber; a flow channel formed along the pressure chamber so as to be capable of supplying liquid; a piezoelectric member formed between the pressure chamber and the air chamber so as to drive the liquid stored in the pressure chamber to flow toward the ejection port by causing the inner walls of the pressure chamber to be deformed by expansion and contraction; and a connection flow channel for making the pressure chamber communicate with the flow channel at the side of the ejection port.

Further features of the present invention will become apparent from the following description of exemplary embodiments with reference to the attached drawings.

DESCRIPTION OF THE EMBODIMENTS (First Embodiment)

Figure 1A:
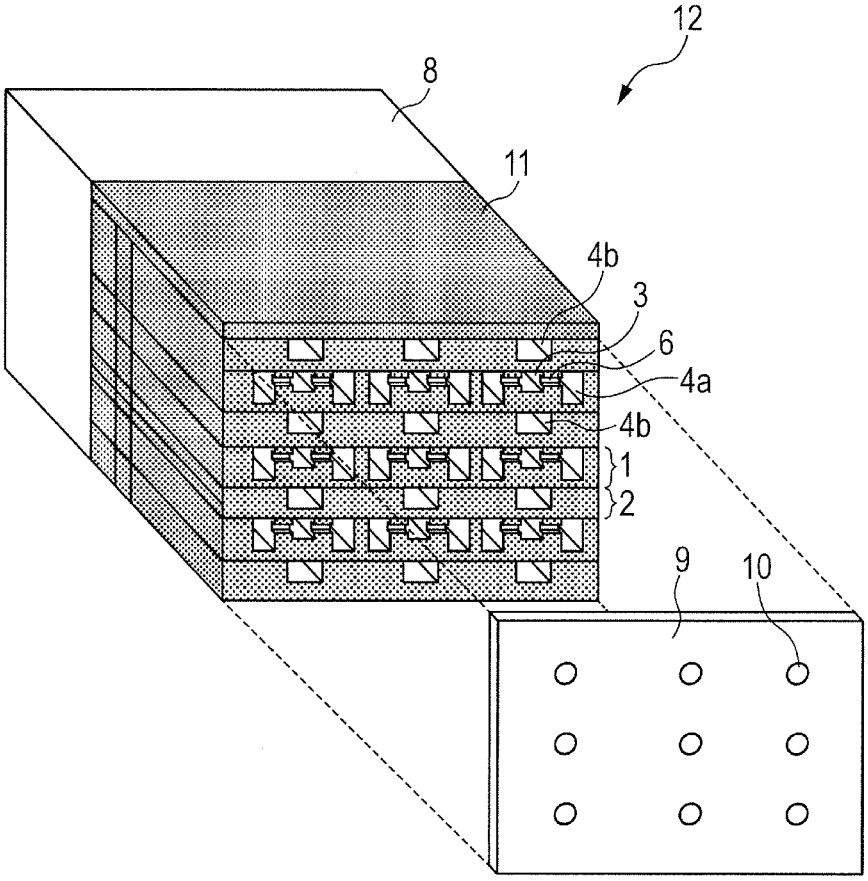
FIGS. 1A and 1B are a schematic perspective view and an enlarged schematic perspective view of the first embodiment of liquid ejection head, illustrating the configuration thereof.
Figure 1B:
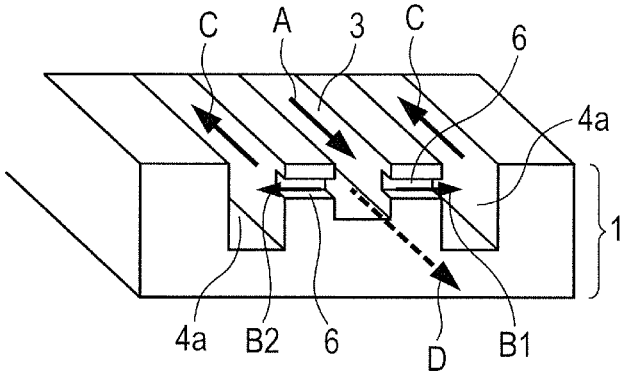

FIGS. 1A and 1B are a schematic perspective view and an enlarged schematic perspective view of the first embodiment of liquid ejection head according to the present invention, illustrating the configuration thereof. FIG. 1A is a schematic perspective view of the first embodiment of liquid ejection head of the present invention, illustrating the appearance thereof. FIG. 1B is an enlarged schematic perspective view of the piezoelectric block body illustrated in FIG. 1A as viewed from the front side.

As illustrated in FIG. 1A, the liquid ejection head 12 of this embodiment has an ink pool plate 8, a piezoelectric block body 11 and a nozzle plate 9. The nozzle plate 9 is bonded to the front surface of the piezoelectric block body 11. In FIG. 1A, the piezoelectric block body 11 and the nozzle plate 9 are separated from each other for easy understanding of the structure of the piezoelectric block body 11. A plurality of ejection ports 10 are produced by so many circular through holes that are bored through the nozzle plate 9. The ejection ports 10 are arranged two-dimensionally with predetermined regular intervals. The ink pool plate 8 is bonded to the back surface of the piezoelectric block body 11.

The piezoelectric block body 11 is a laminate formed by alternately laying a plurality of first plates 1 and a plurality of second plates 2. Both the plates 1 and the plates 2 are piezoelectric substances. A plurality of grooves representing a rectangular cross section that are designed to become so many pressure chambers 3 that are capable of storing liquid and also a plurality of grooves also representing a rectangular cross section that are designed to become so many flow channels 4*a* are formed in each of the plates 1. The grooves for forming the flow channels 4*a* are arranged at the opposite sides of the pressure chambers 3. On the other hand, a plurality of grooves that represent a rectangular cross section and designed to become so many air chambers 4*b* are formed in each of the plates 2. A plurality of pressure chambers 3 and a plurality of flow channels 4*a* are formed as the plates 1 and 2 are laid one on the other and the open tops of the grooves 1 of the plates 1 are closed by the plates 2. The flow channels 4*a* are employed to collect by way of connection channels 6 the residual ink that is left behind after ink is ejected from the ejection ports 10 by way of the pressure chambers 3. The collected ink can be ejected again by way of the pressure chambers as the ink is made to circulate in this way. In some modes of operation, however, the ink collected by way of the flow channels 4*a* is not forced to circulate but collected in holder containers as waste ink.

Additionally, a plurality of air chambers 4*b* are formed as the plates 1 close the open tops of the grooves in the plates 2. The flow channels 4*a* and the air chambers 4*b* are arranged at the four sides of the pressure chambers 3. Electrodes are arranged on the inner walls of the pressure chambers 3, the flow channels 4*a* and the air chambers 4*b*. As a voltage is applied between the pressure chambers 3 and the flow channels 4*a* and between the pressure chambers 3 and the air chambers 4*b*, the walls between them are deformed by expansion and contraction. Then, as a result, liquid droplets are ejected from each of the ejection ports 10.

Thus, the liquid ejection head 12 of this embodiment is so designed that flow channels 4*a* and air chambers 4*b* are arranged between pressure chambers 3 and the pressure chambers 3 are connected to one another by piezoelectric members. Therefore, the structure surrounding the pressure chambers 3 represents an enhanced rigidity if compared with an arrangement where pressure chambers 3 are separated from one another by spaces.

Additionally, connection flow channels 6 are arranged at the ejection port side (nozzle plate 9 side) end facets of the plates 1, or at the front surface of the piezoelectric block body 11, in order to make each of the pressure chambers 3 communicate with the flow channels 4*a* as illustrated in FIG. 1B. In each of the pressure chambers 3, liquid flows in the direction directed toward the nozzle plate 9 (in the direction indicated by arrow A). Then, the liquid is branched to flow through the related connection flow channels 6 in the direction indicated by arrow B1 and in the direction indicated by arrow B2 that are orthogonal relative to the direction of arrow A. Subsequently, the liquid flows through the flow channels 4*a* in the direction indicated by arrow C that is opposite to the direction of arrow A. The front ends of the ejection ports 10 are held under negative pressure by means of pressure adjustment until a predetermined ejection signal is input to the piezoelectric block body 11. Therefore, no liquid leaks out from the ejection ports 10. As an ejection signal is input to the piezoelectric block body 11, liquid droplets are ejected from the ejection ports 10 in the ejection direction (the direction indicated by arrow D). At this time, the flow channels 4*a* operate as circulation flow channels so that liquid is led to circulate between each of the pressure chambers 3 and related ones of the flow channels. As a result, the ejection ports 10 are prevented from clogging with dust and dried ink. Additionally, if air bubbles exist on the inner walls of the pressure chambers 3, they are removed from the wall surfaces and released away as they are borne by circulating liquid flows.

(Second Embodiment)

Figure 2A:
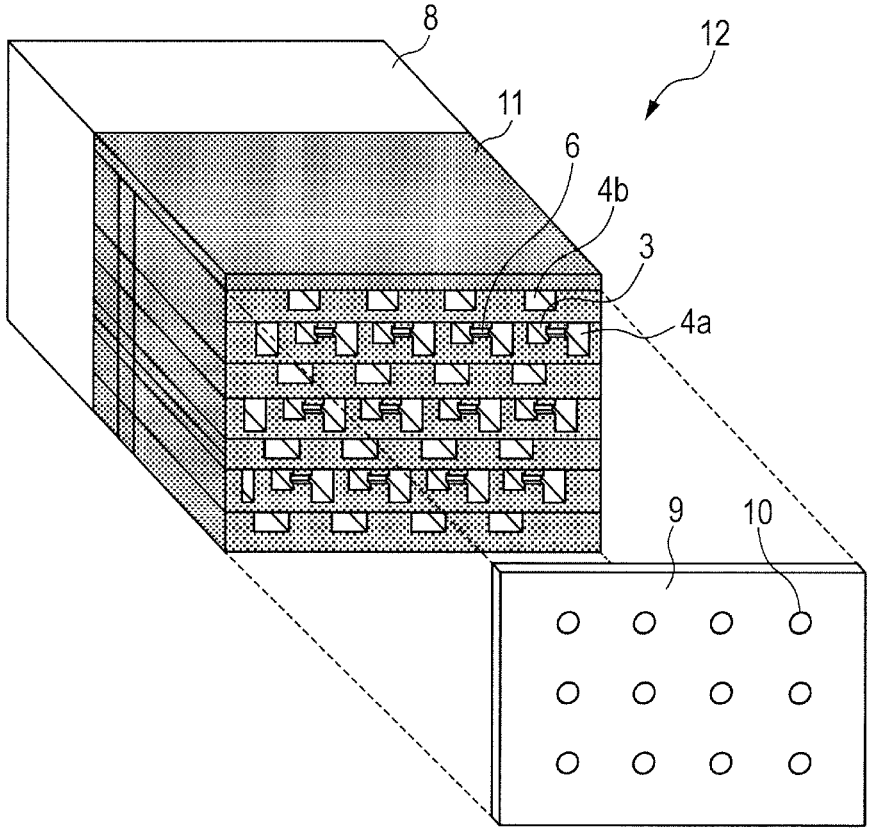
FIGS. 2A and 2B are a schematic perspective view and an enlarged schematic perspective view of the second embodiment of liquid ejection head, illustrating the configuration thereof.
Figure 2B:
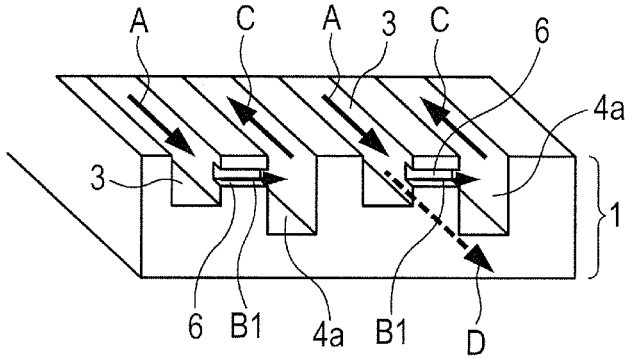

FIGS. 2A and 2B are a schematic perspective view and an enlarged schematic perspective view of the second embodiment of liquid ejection head according to the present invention, illustrating the configuration thereof. FIG. 2A is a schematic perspective view of the second embodiment of liquid ejection head of the present invention, illustrating the appearance thereof. FIG. 2B is an enlarged schematic perspective view of the piezoelectric block body illustrated in FIG. 2A as viewed from the front side. The components similar to those of the first embodiment are denoted by the same reference symbols and will not be described in detail.

This embodiment differs from the first embodiment in terms of the number of flow channels 4*a*. In the first embodiment, two flow channels 4*a* are arranged between two adjacently located pressure chambers 3 as illustrated in FIG. 1A. In other words, two circulation flow channels are formed for each pressure chamber 3 in the first embodiment. With that arrangement, the liquid that flows out from each pressure chamber 3 is branched into two directions (the direction of arrow B1 and the direction of arrow B2) and then flows into two flow channels 4*a* by way of two connection flow channels 6. In this second embodiment, on the other hand, pressure chambers 3 and flow channels 4*a* are arranged alternately and each pressure chamber 3 communicates with a single flow channel 4*a* by way of a connection flow channel 6, as illustrated in FIGS. 2A and 2B. In other words, a single circulation flow channel is formed for a single pressure chamber 3. With this arrangement, the liquid that flows out from a pressure chamber 3 subsequently flows through a single connection flow channel 6 in a single direction (the direction of arrow B1) and then flows into a single flow channel 4*a*.

With this embodiment of liquid ejection head, pressure chambers 3 can be arranged highly densely if compared with the first embodiment of liquid ejection head because the liquid ejection head of this embodiment includes a fewer number of flow channels 4*a*.

(Third Embodiment)

Figure 3A:
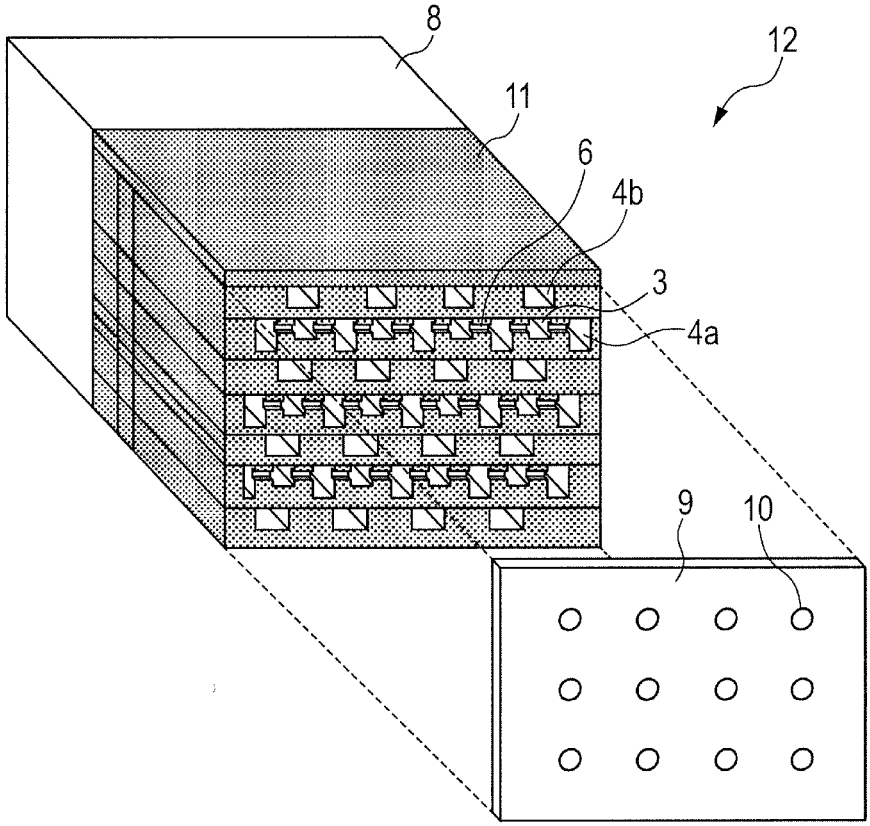
FIGS. 3A and 3B are a schematic perspective view and an enlarged schematic perspective view of the third embodiment of liquid ejection head, illustrating the configuration thereof.
Figure 3B:
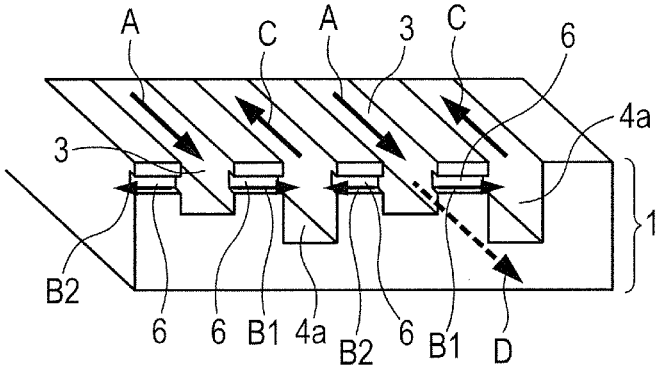

FIGS. 3A and 3B are a schematic perspective view and an enlarged schematic perspective view of the third embodiment of liquid ejection head according to the present invention, illustrating the configuration thereof. FIG. 3A is a schematic perspective view of the third embodiment of liquid ejection head of the present invention, illustrating the appearance thereof. FIG. 3B is an enlarged schematic perspective view of the piezoelectric block body illustrated in FIG. 3A as viewed from the front side. The components similar to those of the first and second embodiments are denoted by the same reference symbols and will not be described in detail.

In this embodiment, pressure chambers 3 and flow channels 4*a* are arranged alternately and each of the flow channels 4*a* interposed between two pressure chambers 3 is shared by the two pressure chambers 3 as circulation flow channel. In other words, two circulation flow channels are formed for a single pressure chamber 3 and a single circulation flow channel is shared by two pressure chambers 3 in this embodiment. With this arrangement, the liquid that is ejected to flow out from a pressure chamber 3 in the direction of arrow D is branched into two directions (the direction of arrow B1 and the direction of arrow B2) and subsequently flows into two flow channels 4*a* by way of two connection flow channels 6. At this time, each flow channel 4*a* receives the liquid that comes flowing from the two pressure chambers 3 between which the flow channel 4*a* is interposed.

Thus, in this embodiment of liquid ejection head, two circulation flow channels are secured for a single pressure chamber 3 as in the first embodiment and additionally, pressure chambers 3 can be arranged as densely as in the second embodiment.

(Fourth Embodiment)

Figure 4A:
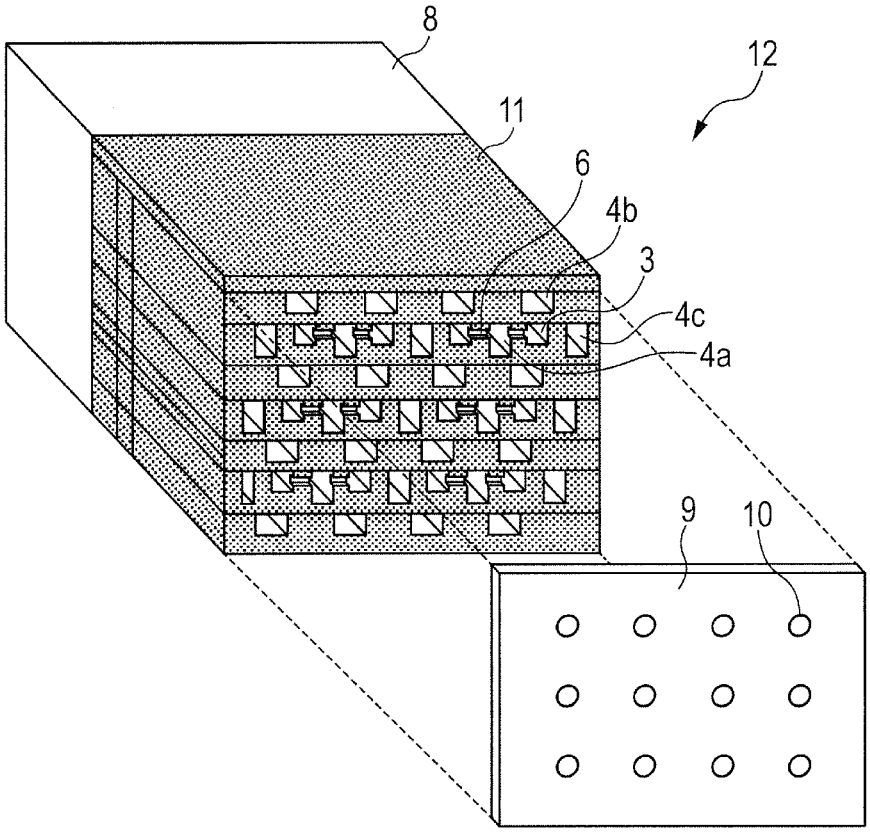
FIGS. 4A and 4B are a schematic perspective view and an enlarged schematic perspective view of the fourth embodiment of liquid ejection head, illustrating the configuration thereof.
Figure 4B:
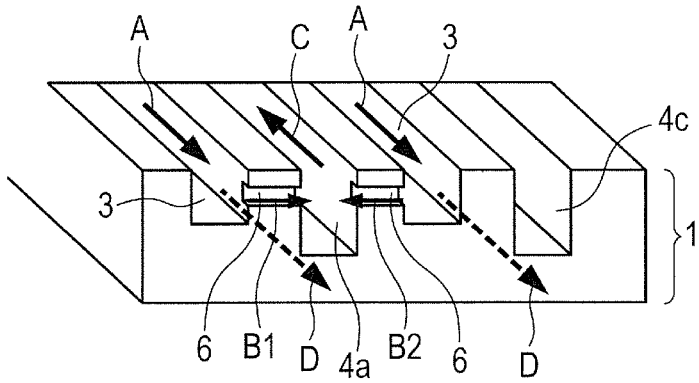

FIGS. 4A and 4B are a schematic perspective view and an enlarged schematic perspective view of the fourth embodiment of liquid ejection head according to the present invention, illustrating the configuration thereof. FIG. 4A is a schematic perspective view of the fourth embodiment of liquid ejection head of the present invention, illustrating the appearance thereof. FIG. 4B is an enlarged schematic perspective view of the piezoelectric block body illustrated in FIG. 4A as viewed from the front side. The components similar to those of the first through third embodiments are denoted by the same reference symbols and will not be described in detail.

In this embodiment, two pressure chambers 3 communicate with a single flow channel 4*a* interposed between them as illustrated in FIGS. 4A and 4B. In other words, circulation flow channels are provided at a rate of one for each pressure chamber 3 but in operation a single circulation flow channel 4*a* is shared by two pressure chambers 3. With this arrangement, as liquid is ejected from two adjacently located pressure chambers 3 in the direction of arrow D, the liquid that flows out from each of the pressure chambers 3 flows into the single flow channel 4*a* interposed between them. Note that the air chamber 4*c*arranged adjacent to a flow channel 4*a* for circulation does not communicate with any pressure chamber and is utilized to make the related piezoelectric substance easily deformable just like air chambers 4*b*.

(Fifth Embodiment)

Figure 5A:
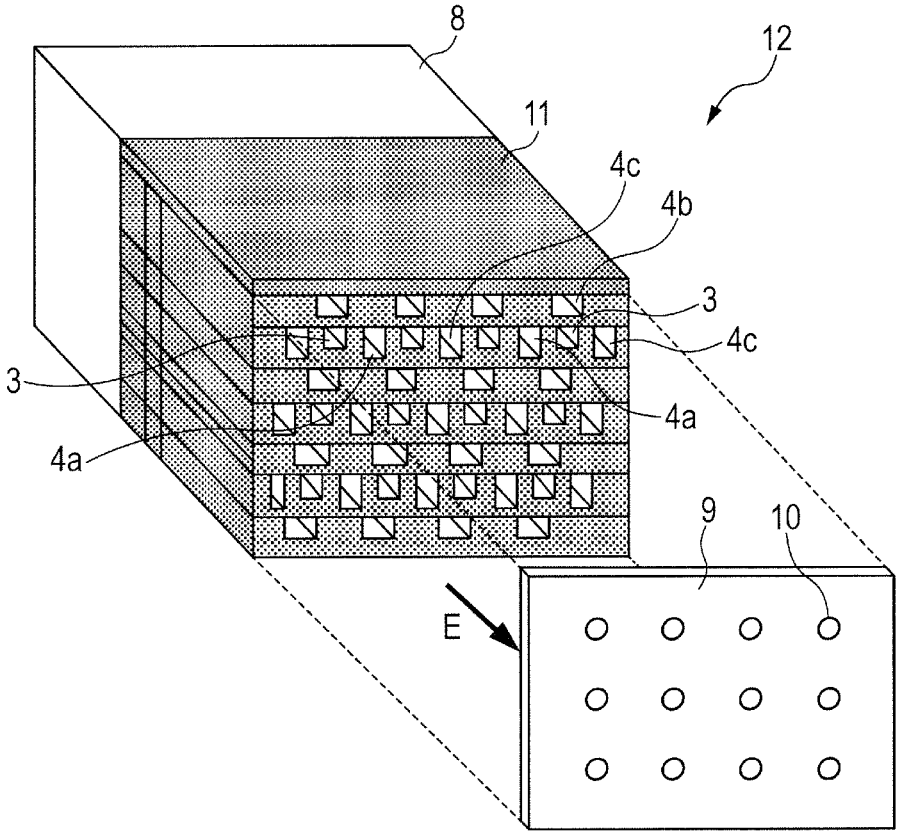
FIGS. 5A and 5B are a schematic perspective view and an enlarged schematic perspective view of the fifth embodiment of liquid ejection head, illustrating the configuration thereof.
Figure 5B:
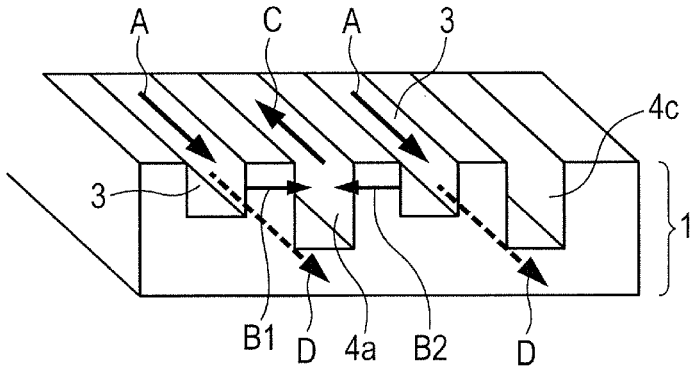
Figure 6A:
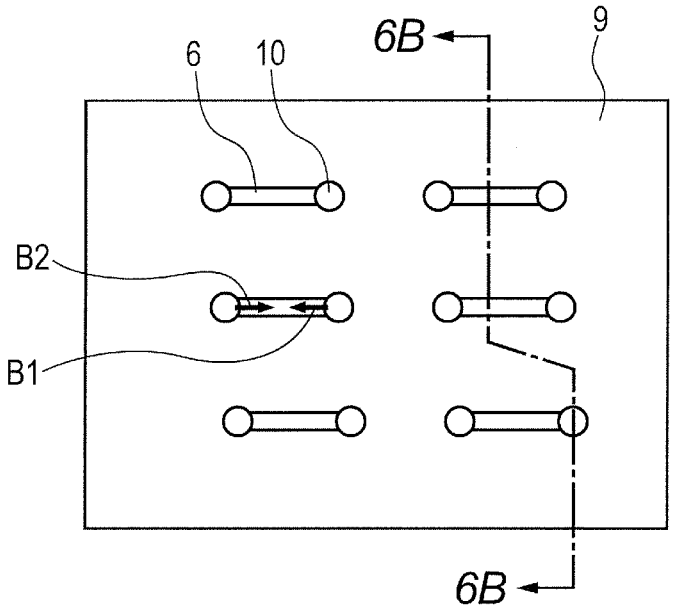
FIGS. 6A and 6B are a back view and a cross-sectional view of the nozzle plate illustrated in FIG. 5A, illustrating the configuration thereof.
Figure 6B:
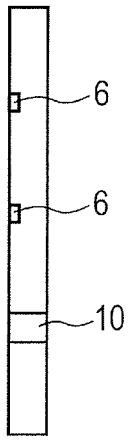

FIGS. 5A and 5B are a schematic perspective view and an enlarged schematic perspective view of the fifth embodiment of liquid ejection head according to the present invention, illustrating the configuration thereof. FIG. 5A is a schematic perspective view of the fifth embodiment of liquid ejection head of the present invention, illustrating the appearance thereof. FIG. 5B is an enlarged schematic perspective view of the piezoelectric block body illustrated in FIG. 5A as viewed from the front side. FIGS. 6A and 6B are a back view and a cross-sectional view of the nozzle plate illustrated in FIG. 5A, illustrating the configuration thereof. FIG. 6A is a back view of the nozzle plate 9 illustrated in FIG. 5A as viewed from the back thereof (in the direction of arrow E). FIG. 6B is a cross-sectional view taken along cutting line 6B-6B illustrated in FIG. 6A. The components similar to those of the first through fourth embodiments are denoted by the same reference symbols and will not be described in detail.

This embodiment differs from the first through fourth embodiments in terms of the positions where connection flow channels 6 are formed. In each of the first through fourth embodiments, connection flow channels are formed at the front surface of the piezoelectric block body 11 (plate 1) (see FIGS. 1A to 4B). In this embodiment, on the other hand, groove-shaped connection flow channels 6 are formed at the nozzle plate 9 of the embodiment as illustrated in FIGS. 6A and 6B. The liquid that flows out from each pressure chamber 3 in the direction of arrow A (see FIG. 5B) then flows through a connection flow channel 6 either in the direction of arrow B1 or in the direction of arrow B2 (see FIG. 5B). Thereafter, the liquid flows through a flow channel 4*a* in the direction of arrow C as illustrated in FIG. 5B. A relatively sophisticated machining technique is required to form grooves that operate as connection flow channels 6 on plates 1 (piezoelectric member) as in the case of the first through fourth embodiments. However, connection flow channels 6 can be formed on a nozzle plate 9 relatively easily for this embodiment if compared with forming grooves on plates 1 by machining.

Flow channels 4*a* are formed as circulation flow channels on plates 1 with pressure chambers 3 in the above-described first through fifth embodiments. Alternatively, however, the air chambers 4*b* formed on plates 2 may be employed to operate as circulation flow channels.

(Sixth Embodiment)

Figure 7:
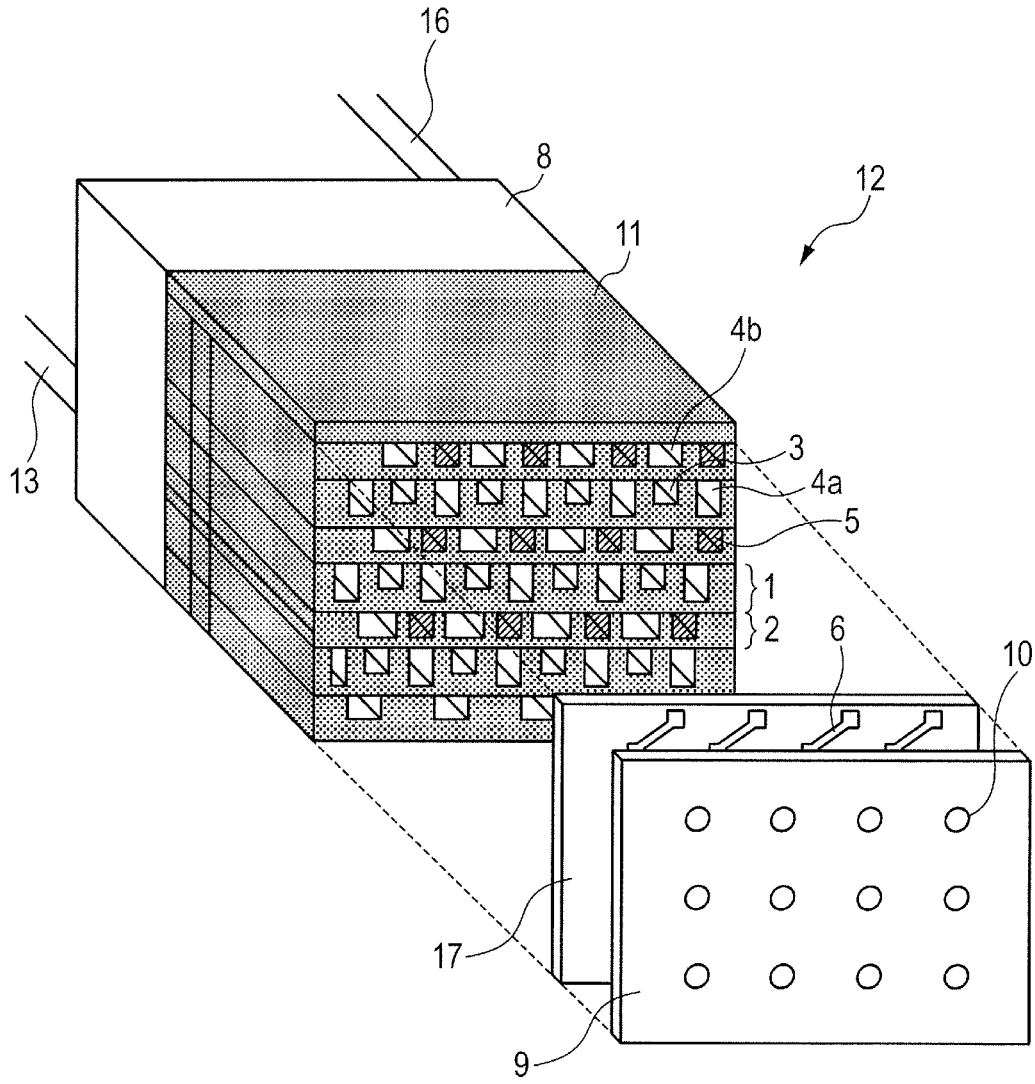
FIG. 7 is a schematic perspective view of the sixth embodiment of liquid ejection head, illustrating the appearance thereof.
Figure 8:
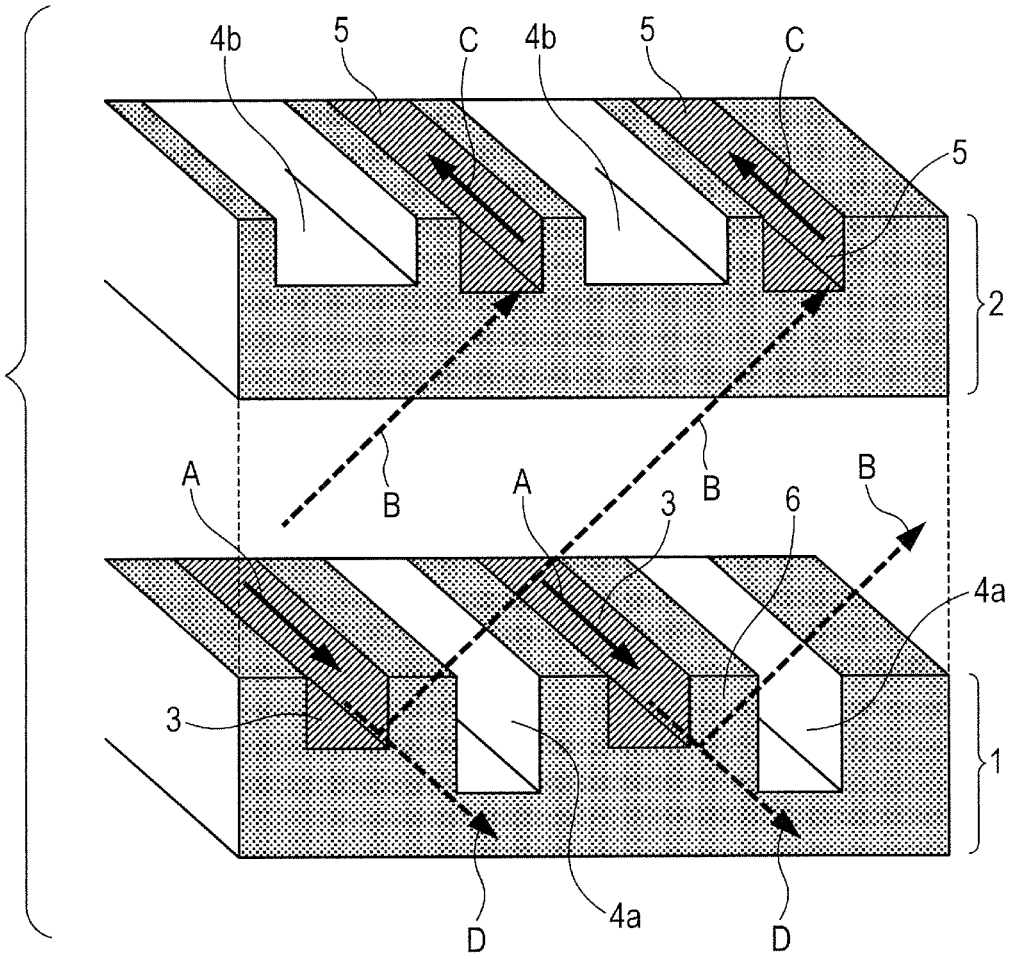
FIG. 8 is an enlarged schematic front view of the piezoelectric block body illustrated in FIG. 7.

FIG. 7 is a schematic perspective view of the sixth embodiment of liquid ejection head, illustrating the appearance thereof. FIG. 8 is an enlarged schematic front view of the piezoelectric block body illustrated in FIG. 7. The components similar to those of the first through fifth embodiments are denoted by the same reference symbols and will not be described in detail.

In the liquid ejection head 12 of this embodiment, a plurality of air chambers 4*b* and a plurality of circulation flow channels 5 (additional grooves representing a rectangular cross section) are arranged alternately on plates 2. Air chambers 4*a* and 4*b* are arranged at the four sides of each pressure chamber 3 and electrodes are formed on the inner walls of each of the air chambers 4*a* and 4*b*. In this liquid ejection head 12, as a voltage is applied between the pressure chambers 3 and the air chambers 4*a* and between the pressure chambers 3 and the air chambers 4*b*, the walls between them are deformed by expansion and contraction. Then, as a result, liquid droplets are ejected from each of the ejection ports 10. No electrodes are formed on the inner walls of the circulation flow channels 5 or, if electrodes are formed on them, no voltage is applied to the electrodes. Thus, as a result, the walls of the circulation flow channels 5 are neither expanded nor contracted so that they are not deformed when liquid droplets are ejected from the ejection ports 10.

Figure 9:
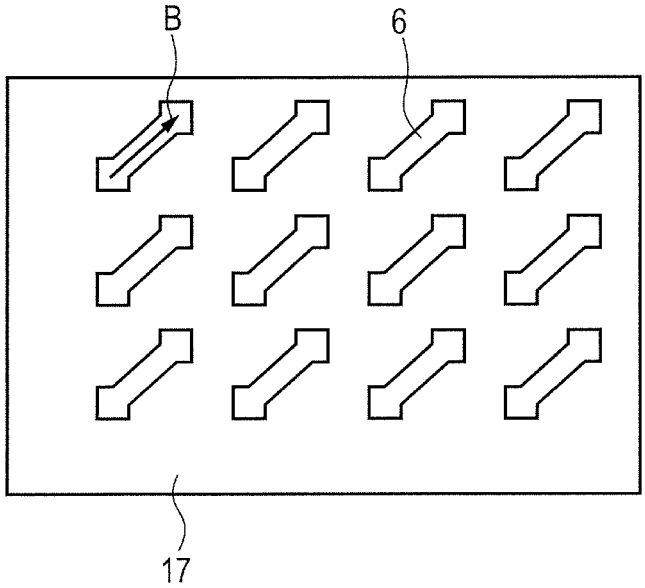
FIG. 9 is a schematic front view of the connection flow channel plate illustrated in FIG. 7.
Figure 10:
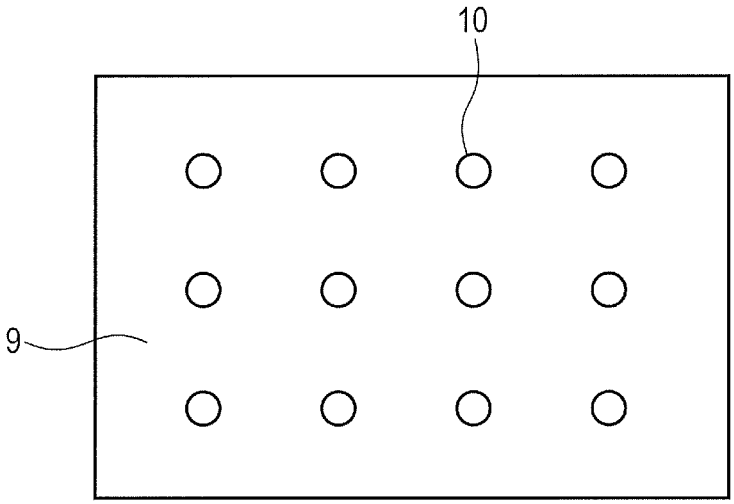
FIG. 10 is a schematic front view of the nozzle plate illustrated in FIG. 7.
Figure 11A:
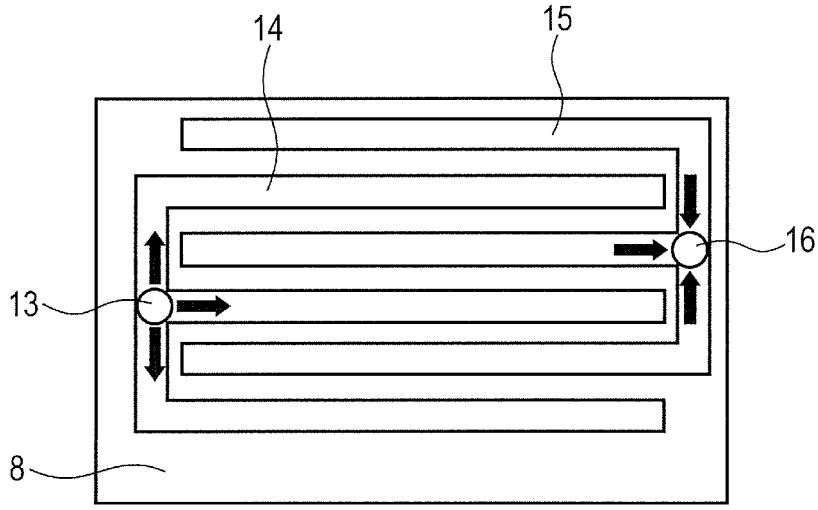
FIGS. 11A and 11B are a schematic plan view and a schematic front view of the ink pool plate.
Figure 11B:
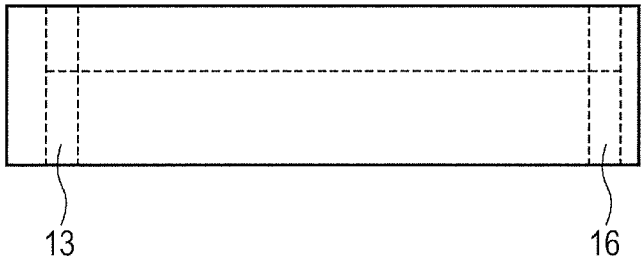

Additionally, the liquid ejection head 12 of this embodiment is provided with a connection flow channel plate (flat plate member) between the piezoelectric block body 11 and the nozzle plate 9. FIG. 9 is a schematic front view of the connection flow channel plate 17 illustrated in FIG. 7. FIG. 10 is a schematic front view of the nozzle plate 9 illustrated in FIG. 7. Connection flow channels 6 are formed on the connection flow channel plate 17 such that each of them makes the related pressure chamber 3 communicate with a flow channel 5 located obliquely above the pressure chamber 3 (in the direction of arrow B). Each of the connection flow channel 6 is made to run through the connection flow channel plate 17 at one of its ends located at the side of the pressure chamber 3 so as to make the pressure chamber 3 communicate with an ejection port 10. FIGS. 11A and 11B are a schematic plan view and a schematic front view of the ink pool plate 8 of the embodiment. Now, the flow of ink in the liquid ejection head 12 of this embodiment will be described below.

The ink supplied to the ink pool plate 8 by way of the ink supply port 13 flows into the pressure chambers 3 of the piezoelectric block body 11 by way of ink supply flow channels 14 (see FIG. 11A). In each of the pressure chambers 3, ink flows in the direction of arrow A (see FIG. 8) into the connection flow channel 6. In the connection flow channel 6, ink flows in the direction of arrow B (see FIG. 8) into the circulation flow channel 5. In the circulation flow channel 5, ink flows in the direction of arrow C. Thereafter, ink is discharged to the outside of the liquid ejection head from the ink collection port 16 by way of ink collection flow channels 15 (see FIGS. 11A and 11B).

In this embodiment, the four walls of each of the pressure chambers 3 are held in contact with respective air chambers 4*a* and 4*b*. Since the air chambers 4*a* and 4*b* are not filled with liquid, a strong drive force can be obtained and the vibrations in the driven pressure chambers are hardly transmitted to the pressure chambers surrounding them. Furthermore, the circulation flow channels 5 are designed so as not to be deformed during an ink ejecting operation. Thus, stability of liquid ejection can be improved.

While this embodiment is so designed that a circulation flow is generated and circulated through a pressure chamber 3, a connection flow channel 6 and a circulation flow channel 5 in the above-mentioned order during ink ejection, the embodiment may alternatively be so designed that a circulation flow is generated and circulated through a circulation flow channel 5, a connection flow channel 6 and a pressure chamber 3 during each time period of not ejecting ink by pressure adjustment.

(Seventh Embodiment)

Figure 12:
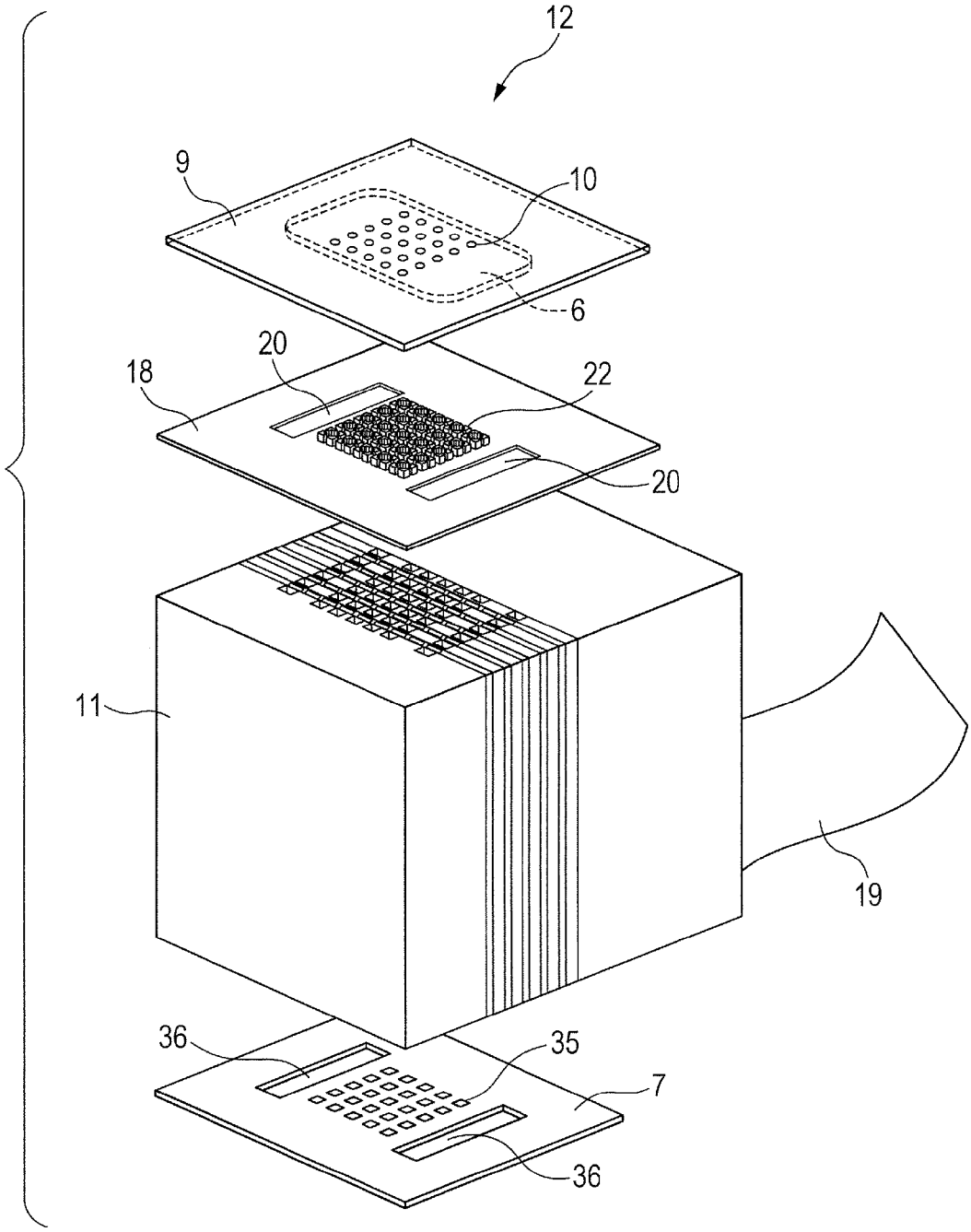
FIG. 12 is an exploded perspective view of the seventh embodiment of liquid ejection head of the present invention.
Figure 13:
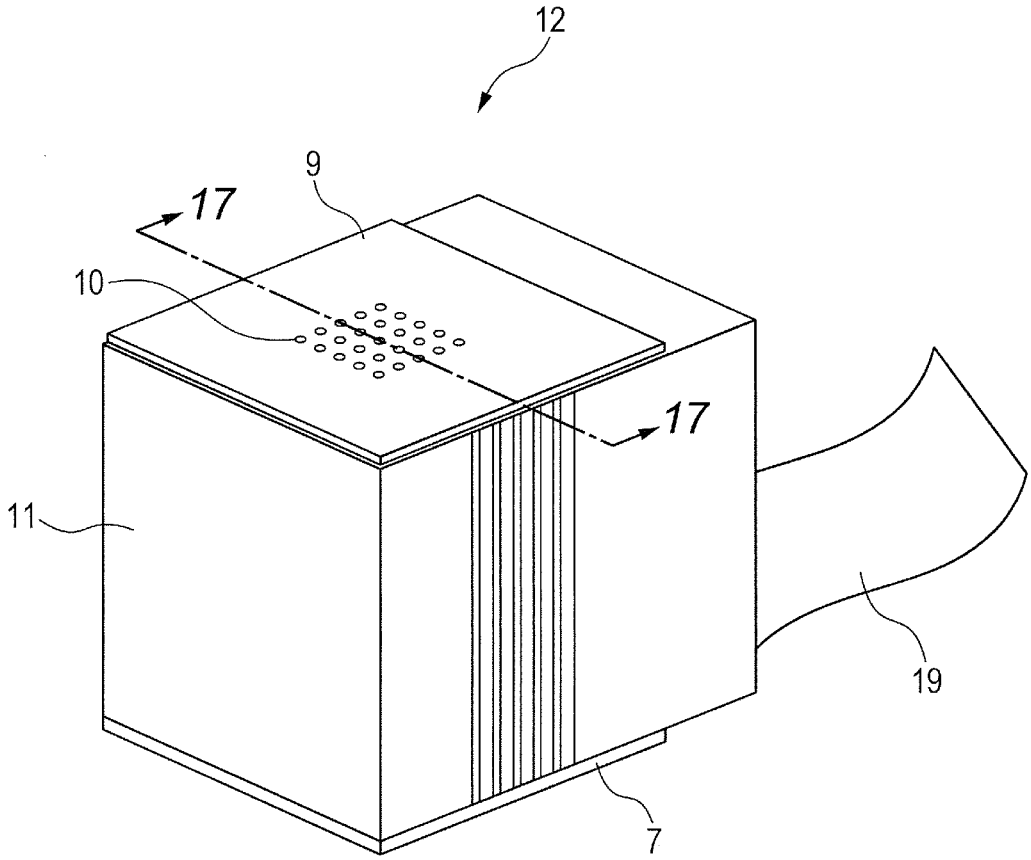
FIG. 13 is a schematic perspective view of the liquid ejection head illustrated in FIG. 12 in an assembled state.

FIG. 12 is an exploded perspective view of the seventh embodiment of liquid ejection head of the present invention. FIG. 13 is a schematic perspective view of the liquid ejection head 12 illustrated in FIG. 12 in an assembled state. The components similar to those of the first through sixth embodiments are denoted by the same reference symbols and will not be described in detail.

The liquid ejection head 12 of this embodiment is formed by laying a nozzle plate 9, a common circulation flow channel forming member 18 (flat plate member), a piezoelectric block body 11 and a fluid control plate 7 one on the other in the above-mentioned order and bonded together. A flexible cable 19 is fitted to an end facet (back surface) of the piezoelectric block body 11. The flexible cable 19 is connected to a liquid ejection head drive section (not illustrated) of a recording apparatus main body.

A connection flow channel 6 having a rectangular cross section is formed on the surface (back surface) of the nozzle plate 9 that is to be bonded to the common circulation flow channel forming member 18. The connection flow channel 6 is formed in the ejection port 10 forming region.

Figure 14A:
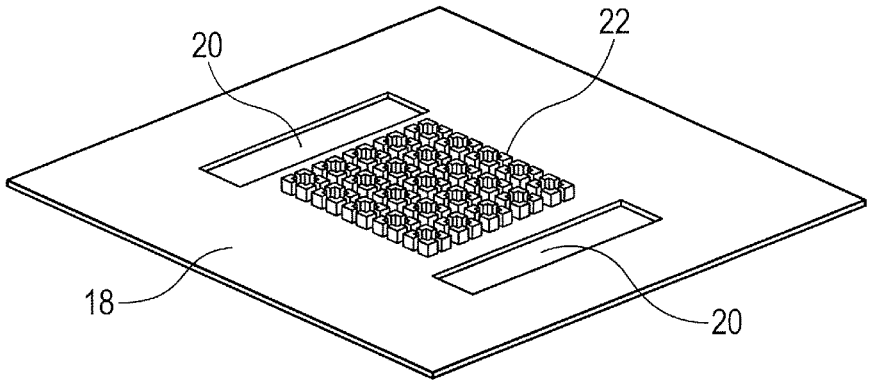
FIGS. 14A and 14B are a schematic perspective view and a schematic front view of the common circulation flow channel forming member, illustrating a configuration thereof.
Figure 14B:
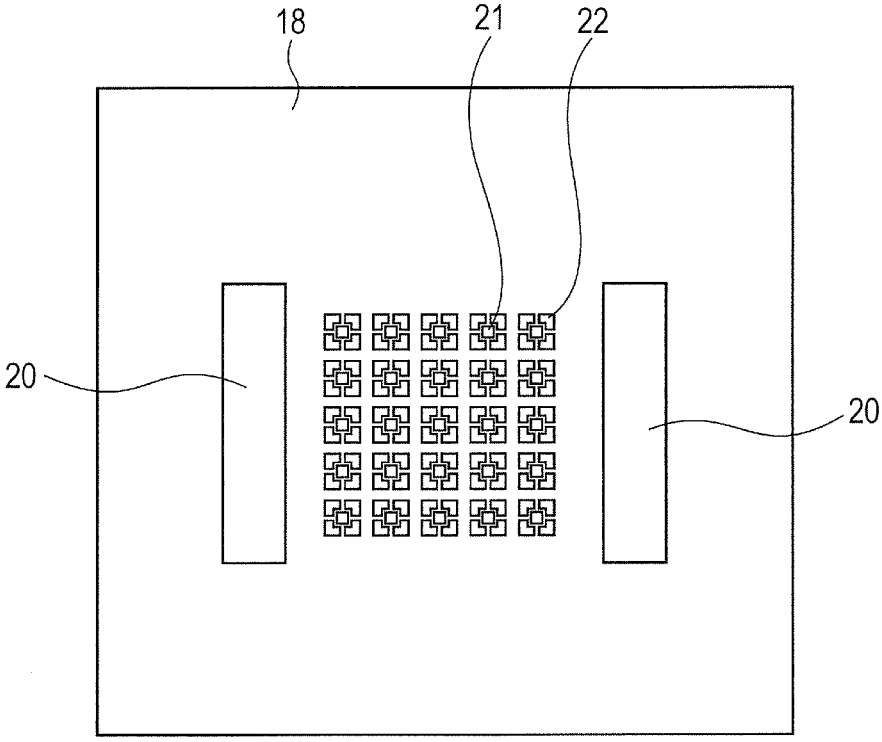

The configuration of the common circulation flow channel forming member 18 will be described below by referring to FIGS. 14A and 14B. FIG. 14A is a schematic perspective view of the common circulation flow channel forming member 18. FIG. 14B is a schematic front view of the common circulation flow channel forming member 18. Two first inflow ports 20, a plurality of outflow ports 21 arranged between the first inflow ports 20 and a plurality of limiting sections 22 are formed in the common circulation flow channel forming member 18. The outflow ports 21 are through holes arranged two-dimensionally so as to squarely face the respective ejection ports 10. The limiting sections 22 are projecting members configured to discontinuously surround the ejection ports 10. As the nozzle plate 9 and the common circulation flow channel forming member 18 are bonded to each other, the limiting sections 22 contacts the bottom of the connection flow channel 6 formed on the nozzle plate 9.

The fluid control plate 7 will now be described below by referring to FIG. 12. Rear side limiters 35 are formed on the fluid control plate 7 at positions corresponding to the relative pressure chambers 3. The rear side limiters 35 limit the back-flow of ink so as to strongly direct the ink flow generated by drive force toward the ejection ports 10. Second inflow ports 36 that are also through holes are formed at the opposite sides of the rear side limiters 35.

Figure 15A:
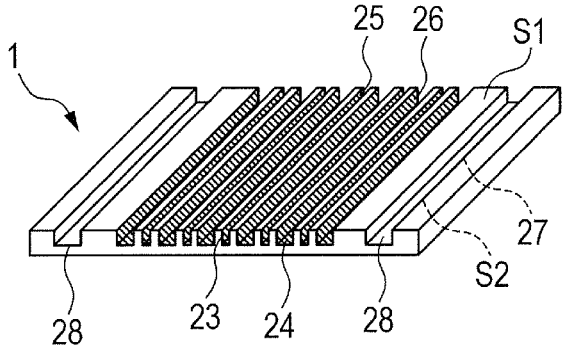
FIGS. 15A, 15B and 15C are exploded schematic perspective views and an assembly diagram of the plates for forming a piezoelectric block body.
Figure 15B:
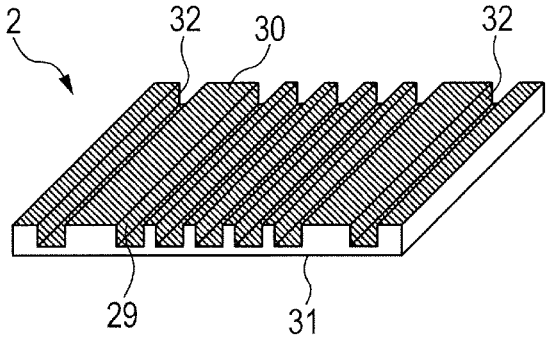
Figure 15C:
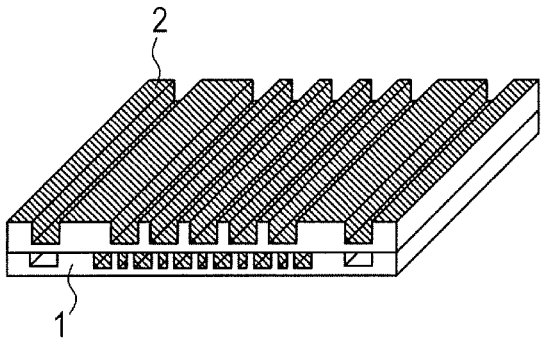

The piezoelectric block body 11 will be described below. FIGS. 15A through 15C are exploded schematic perspective views and an assembly diagram of the plates 1 and 2 for forming a piezoelectric block body 11. FIG. 15A is a schematic perspective view of a plate 1. FIG. 15B is a schematic perspective view of a plate 2. FIG. 15C is a schematic assembly diagram of the plate 1 illustrated in FIG. 15A and the plate 2 illustrated in FIG. 15B.

As illustrated in FIG. 15A, grooves 23 and grooves 24 having a rectangular cross section are arranged alternately and in parallel with each other on the first main surface S1 of the plate 1. First electrodes (SIG) 25 are formed on the inner wall surfaces of the grooves 23 and second electrodes (GND) 26 are formed on the inner wall surfaces of the grooves 24. "SIG" stands for a signal and "GND" stands for grounding. A third electrode (GND) 27 is formed on the entire region of the second main surface S2 that is the rear surface relative to the first main surface S1. The third electrode (GND) 27 may be omitted. Additionally, grooves 28 having a rectangular cross section are formed on the plate 1 outside (at the opposite sides of) the region where the grooves 23 and 24 are formed. Electrodes may or may not be formed on the inner wall surfaces of the grooves 28.

As illustrated in FIG. 15B, a plurality of grooves 29 are formed in parallel with each other on the plate 2 at positions corresponding to the grooves 23 formed on the plate 1. A fourth electrode (GND) 30 is formed on the entire surface of the plate 2 where the grooves 29 are arranged, including the inner wall surfaces of the grooves 29. Fifth electrodes (SIG) 31 are formed on the rear surface of the plate 2 at positions located directly above the respective grooves 23 formed on the plate 1. Additionally, grooves 32 are formed on the plate 2 outside (at the opposite sides of) the region where the grooves 29 are formed. Electrodes may or may not be formed on the inner wall surfaces of the grooves 32. The grooves 32 are formed at positions corresponding to the grooves 28 formed on the plate 1.

As illustrated in FIG. 15C, the plate 1 and the plate 2 are bonded to each other in such a way that the open sides of all the grooves 23, 24 and 29 face the same direction.

Figure 16A:
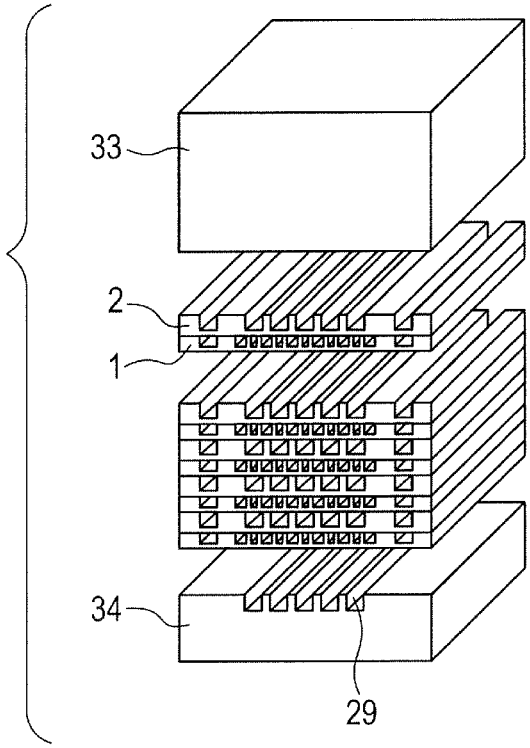
FIGS. 16A and 16B are schematic perspective views of a piezoelectric block body, illustrating a manufacturing process thereof.
Figure 16B:
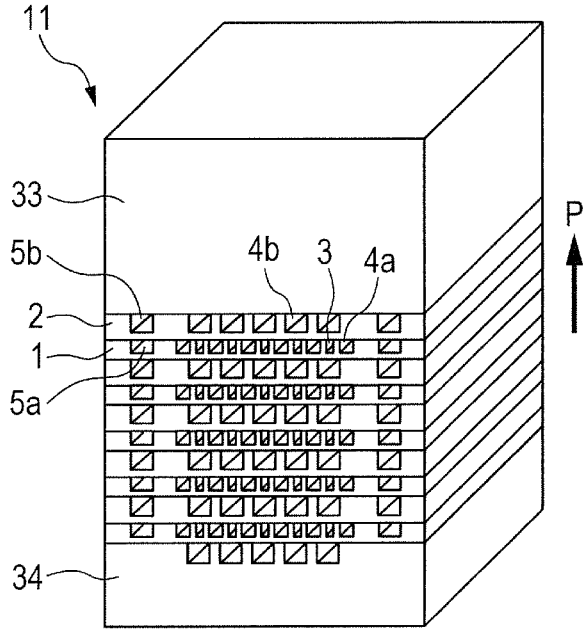

FIGS. 16A and 16B are schematic perspective views of the piezoelectric block body 11, illustrating a manufacturing process thereof. FIG. 16A is an exploded perspective view of the piezoelectric block body 11 in a state before completion. FIG. 16B is a schematic perspective view of the piezoelectric block body 11 after completion.

As illustrated in FIG. 16A, a body formed by bonding a single plate 1 and a single plate 2 forms a unit and a plurality of units are laid one on the other. Thereafter, the plurality of units that are bonded together are sandwiched between and bonded to a first substrate 33 and a second substrate 34 to produce a complete piezoelectric block body 11 as illustrated in FIG. 16B. The first substrate 33 and the second substrate 34 are flat plate members that are piezoelectric members where no pattern is formed. While the first substrate 33 and the second substrate 34 may not necessarily be piezoelectric substances, they preferably are made of a material having a thermal expansion coefficient close to that of the plates 1 and the plates 2 when they need to be heated at the time of bonding.

As illustrated in FIG. 16B, in the piezoelectric block body 11, the pressure chambers 3 are produced as all the openings of the grooves 23 are closed by means of the plates 2 while the air chambers 4*a* are produced as all the openings of the grooves 24 are closed by means of the plates 2 and the air chambers 4*b* are produced as all the openings of the groove 29 are closed by means of the plates 1 or the first substrate 33. The air chambers 4*b* and the pressure chambers 3 are aligned in the direction P in which the plates 1 and 2 are stacked. The first circulation flow channels 5*a* are produced as all the openings of the grooves are closed by means of the plates 2. The second circulation flow channels 5*b* are produced as all the openings of the grooves 32 are closed by means of the plates 1 or the first substrate 33. An electrode pad (not illustrated) is formed on the surface (back surface) of the piezoelectric block body 11 that is to be bonded to the fluid control plate 7. Wiring members are arranged on the lateral surfaces of the piezoelectric block body 11 so as to electrically connect the electrode pad to the electrodes formed on the inner walls of the pressure chambers 3, the air chambers 4*a* and the air chambers 4*b*. The electrode pad is electrically connected to the above-described liquid ejection head drive section (not illustrated) by way of the flexible cable 19.

Figure 17:
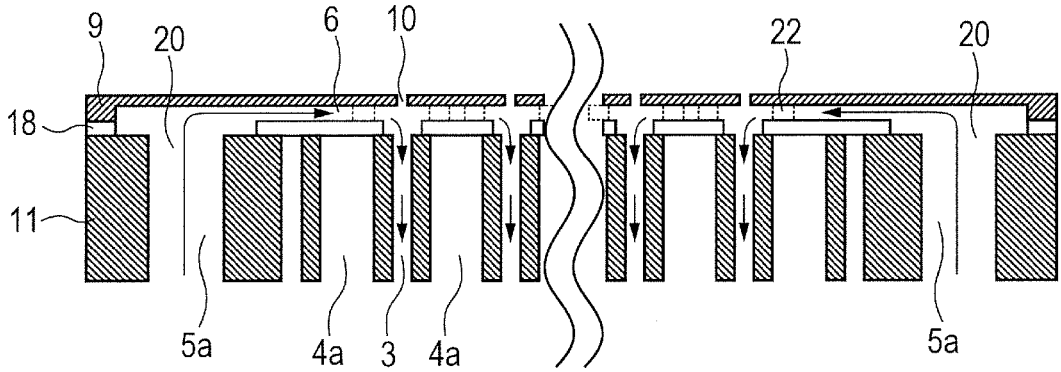
FIG. 17 is a schematic cross-sectional view taken along cutting line 17-17 illustrated in FIG. 13.

Now, how ink flows in the liquid ejection head 12 of this embodiment will be described below by referring to FIG. 17. FIG. 17 is a schematic cross-sectional view taken along cutting line 17-17 illustrated in FIG. 13. Ink flows from the second inflow ports 36 of the control plate 7 into the piezoelectric block body 11. In the piezoelectric block body 11, ink flows through the first circulation flow channels 5*a* and the second circulation flow channels 5*b* (not illustrated in FIG. 17). Then, ink flows through the first inflow ports 20 of the common circulation flow channel forming member 18 and into the connection flow channel 6 of the nozzle plate 9. Thereafter, ink flows through the gaps of the limiting sections 22 and into the pressure chambers 3. With the above-described flow channel configuration, any pressure loss practically does not arise because the fluid resistance is small in the connection flow channel 6. Thus, the pressures at and near the ejection ports 10 can be made substantially equal to each other for all the pressure chambers 3 so that the pressure relationship between the connection flow channel 6 and the plurality of pressure chambers 3 can be adjusted with ease. Additionally, problems such as that ink ejected from the ejection ports 10 overflows and that ink is drawn into the flow channels can be prevented from taking place by maintaining the pressure (relative to the atmospheric gauge pressure) at the parts of the ejection ports 10 below the capillary force of the ejection ports 10. Note, however, ink droplets are ejected from the ejection ports 10 as an ink ejection signal is applied. At this time, the ink flow in each pressure chamber 3 is directed in the ejection direction. Since the pressure and the ink flow rate in each pressure chamber 3 at the time of ink droplet ejection are by far greater than the pressure and the ink flow rate of a circulating ink flow, such a circulating ink flow does not practically contribute to the ink droplets ejection. Additionally, the limiting sections 22 suppress the applied pressure in the pressure chambers 3 escaping into the connection flow channel 6 during ink droplet ejecting operations and control the pressure in the pressure chambers 3 so as to be directed toward the ejection ports 10. For this reason, the aperture diameter of the outflow ports 21 needs to be made smaller than the aperture diameter of the pressure chambers 3.

Thus, with this embodiment, ink located at and near the ejection ports 10 can be made to circulate by means of a simple arrangement of forming a single connection flow channel 6 for a plurality of pressure chambers 3. By making ink located at and near the ejection ports 10 constantly circulate, the ejection ports 10 are prevented from clogging with dust and trash and also due to dried ink. Additionally, air bubbles existing in and near the pressure chambers 3 can be removed from the wall surfaces and released away as they are borne by circulating ink flows. Furthermore, ink that is made to flow through the first circulation flow channels 5*a* and the second circulation flow channels 5*b* while ink is being ejected from the liquid ejection head (and hence the piezoelectric block body is being electrically energized) provides an effect of cooling the liquid ejection head 12 (the piezoelectric block body 11).

(Eighth Embodiment)

Figure 18A:
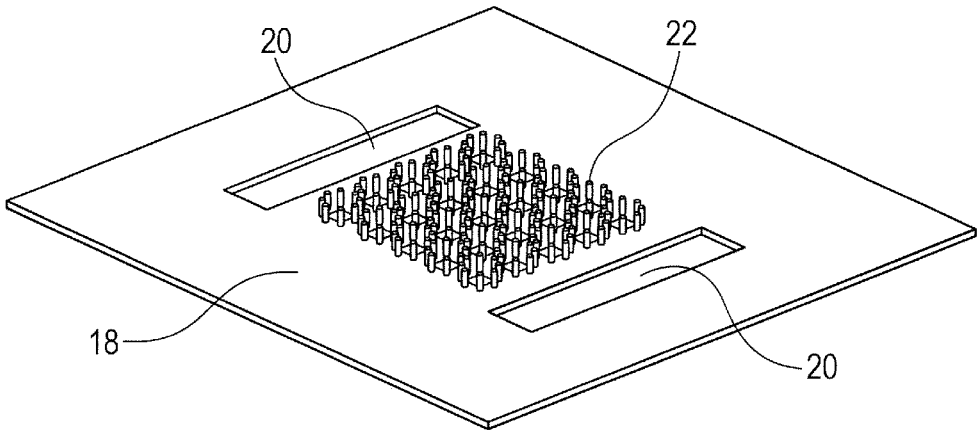
FIGS. 18A and 18B are a schematic perspective view and a schematic front view of the common circulation flow channel forming member, illustrating another configuration.
Figure 18B:
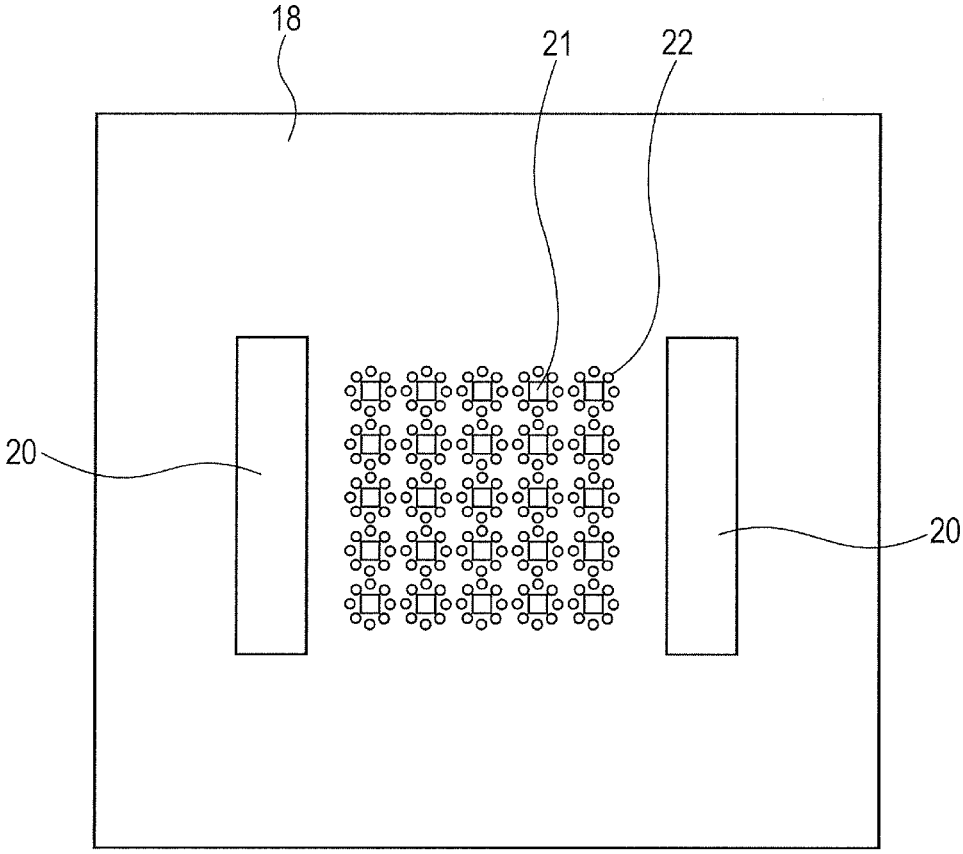

The configuration of the eighth embodiment of liquid ejection head according to the present invention will be described below. The configuration of the liquid ejection head of this embodiment is similar to that of the liquid ejection head of the seventh embodiment except the common circulation flow channel forming member 18. Now, the common circulation flow channel forming member 18 of this embodiment will be described below by referring to FIGS. 18A and 18B. FIG. 18A is a schematic perspective view of the common circulation flow channel forming member 18 of the liquid ejection head of this embodiment. FIG. 18B is a schematic front view of the common circulation flow channel forming member 18 illustrated in FIG. 18A. In this embodiment, each of the limiting sections 22 is formed by a plurality of circular cylinders arranged around an outflow port 21 and separated from each other. By forming limiting sections 22 having such a structure, the limiting sections 22 are prevented from clogging with dust and air bubbles so that circulating ink flows can be established more stably. Note that the limiting sections 22 may alternatively be formed by polygonal cylinders (prisms).

While circulating ink flows are directed from the connection flow channel 6 toward the pressure chambers 3 by pressure adjustment in each of the seventh and eighth embodiments as illustrated in FIG. 17, the pressure chambers 3 and the circulation flow channels 5*a* and 5*b* may be subjected to pressure adjustment so as to generate circulating ink flows in the opposite direction.

The present invention is by no means limited to the above-described first through eighth embodiments particularly in terms of configuration and two or more of the above-described embodiments may be employed in combination. For example, the arrangement of forming connection flow channels 6 at an end facet of the piezoelectric block body 11 as in the first through fourth embodiments and the arrangement of forming circulation flow channels 5 at the piezoelectric block body 11 separately from the air chambers 4*a* and 4*b* as in the sixth through eighth embodiments may be employed in combination. Similarly, the arrangement of forming connection flow channels 6 at the connection flow channel plate 17 as in the sixth embodiment and the arrangement of using any of a plurality of air chambers 4*a* and 4*b* as circulation flow channels 5 as in the first through fourth embodiments may be employed in combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-281731, filed Dec. 22, 2011, which is hereby incorporated by reference herein in its entirety.

What is claimed is:

1. A liquid ejection head comprising:

a piezoelectric block body that has a plurality of pressure chambers storing liquid and arranged two-dimensionally to face respective ejection ports for ejecting liquid, a plurality of air chambers arranged adjacently relative to the plurality of pressure chambers, and a plurality of flow channels arranged along the pressure chambers so as to supply liquid, the pressure chambers, the air chambers and the flow channels being formed therein with piezoelectric members disposed between the plurality of pressure chambers and the plurality of air chambers so as to drive the liquid stored in the pressure chambers to flow toward the ejection ports by causing the inner walls of the pressure chambers to be deformed by expansion and contraction; and a connection flow channel that makes at least one of the pressure chambers communicate with at least one of the flow channels at the side of the related ejection port, wherein the piezoelectric block body is formed by laying a first piezoelectric plate having the pressure chambers and the flow channels on a second piezoelectric plate having the air chambers.

2. The liquid ejection head according to claim 1, wherein the connection flow channel is formed at an end face at the ejection port side of the piezoelectric block body.

3. The liquid ejection head according to claim 1, further comprising a nozzle plate having the ejection ports formed therein, the connection flow channel being formed on the surface of the nozzle plate at the side of the pressure chambers.

4. The liquid ejection head according to claim 3, further comprising a flat plate member arranged between the nozzle plate and the pressure chambers, wherein an inflow port for making the flow channel communicate with the connection flow channel, an outflow port for making the pressure chambers communicate with the ejection ports, the outflow port having an aperture diameter smaller than the aperture size of the pressure chambers, and a plurality of limiting sections discontinuously surrounding the outflow port as projections on the surface at the side of the nozzle plate are formed on the flat plate member.

5. The liquid ejection head according to claim 4, wherein each of the limiting sections is formed by a plurality of circular or polygonal cylinders separated from each other.

6. The liquid ejection head according to claim 1, further comprising:

a nozzle plate having the ejection ports formed therein; and a flat plate member arranged between the nozzle plate and the pressure chambers and having the connection flow channel formed therein.

7. The liquid ejection head according to claim 1, wherein the pressure chambers and the flow channels are formed alternately on the first piezoelectric plate.

8. The liquid ejection head according to claim 1, wherein the liquid supplied from the at least one of the pressure chambers to the at least one of the flow channels by way of the connection flow channel is supplied back to the at least one of the pressure chambers.

9. A liquid ejection head comprising:

a pressure chamber storing liquid and communicating with an ejection port for ejecting liquid;

an air chamber formed adjacently relative to the pressure chamber;

a flow channel formed along the pressure chamber so as to supply liquid;

a piezoelectric member formed between the pressure chamber and the air chamber so as to drive the liquid stored in the pressure chamber to flow toward the ejection port by causing the inner walls of the pressure chamber to be deformed by expansion and contraction; and a connection flow channel for making the pressure chamber communicate with the flow channel at the side of the ejection port of the pressure chamber, wherein the liquid ejection head comprises a first plate forming the pressure chamber and the flow channel, and a second plate forming the air chamber, each of the first and second plates including the piezoelectric member.

10. The liquid ejection head according to claim 9, further comprising a nozzle plate having the ejection port formed therein, the connection flow channel being formed on the surface of the nozzle plate at the side of the pressure chamber.

11. The liquid ejection head according to claim 10, further comprising a flat plate member arranged between the nozzle plate and the pressure chamber, wherein an inflow port for making the flow channel communicate with the connection flow channel, an outflow port for making the pressure chamber communicate with the ejection port, the outflow port having an aperture diameter smaller than the aperture size of the pressure chamber, and a plurality of limiting sections discontinuously surrounding the outflow port as projections on the surface at the side of the nozzle plate are formed on the flat plate member.

12. The liquid ejection head according to claim 11, wherein each of the limiting sections is formed by a plurality of circular or polygonal cylinders separated from each other.

13. The liquid ejection head according to claim 9, further comprising:

a nozzle plate having the ejection port formed therein; and a flat plate member arranged between the nozzle plate and the pressure chamber and having the connection flow channel formed therein.

14. The liquid ejection head according to claim 9, wherein the liquid supplied from pressure chamber to the flow channel by way of the connection flow channel is supplied back to the pressure chamber.

* * * * *